US008177940B2

(12) United States Patent
Kramer et al.

(10) Patent No.: US 8,177,940 B2
(45) Date of Patent: May 15, 2012

(54) APPARATUS AND METHOD FOR STABILIZING A MOVING WEB HAVING TRANSITIONS IN A SURFACE ADJACENT THE WEB

(75) Inventors: Gerald Kramer, Rockton, IL (US); Alain Chamberland, Pincort (CA); Rudy Chang, Lasalle (CA); Paul Richards, Goessendorf (AT); Kurt Mitterboeck, Graz (AT); Edward Brossard, Janesville, WI (US); Joseph Guadagno, Montreal West (CA); Dave Gamble, Acworth, GA (US)

(73) Assignee: Andritz Inc., Glens Falls, NY (US)

( * ) Notice: Subject to any disclaimer, the term of this patent is extended or adjusted under 35 U.S.C. 154(b) by 61 days.

(21) Appl. No.: 12/710,075

(22) Filed: Feb. 22, 2010

(65) Prior Publication Data

US 2010/0224340 A1 Sep. 9, 2010

Related U.S. Application Data

(60) Provisional application No. 61/157,446, filed on Mar. 4, 2009.

(51) Int. Cl.
*D21F 7/00* (2006.01)
*F26B 13/00* (2006.01)
*B65H 23/00* (2006.01)

(52) U.S. Cl. ..... 162/289; 162/193; 162/202; 34/226; 34/242; 34/640; 34/641; 226/97.1; 226/97.3; 242/615.11; 242/615.4

(58) Field of Classification Search ..... 162/193, 162/202, 283, 289; 226/91, 97.1, 97.3; 242/615.11, 242/615.4; 34/641; 244/35 R
See application file for complete search history.

(56) References Cited

U.S. PATENT DOCUMENTS

| | | | | |
|---|---|---|---|---|
| 1,470,017 | A * | 10/1923 | Lougheed | 244/35 R |
| 1,480,327 | A * | 1/1924 | Wisenant | 244/35 R |
| 1,719,293 | A * | 7/1929 | Gripon | 244/35 R |
| 1,763,257 | A * | 6/1930 | Roscoe | 244/35 R |
| 1,773,280 | A * | 8/1930 | Scott | 244/35 R |
| 1,773,281 | A * | 8/1930 | Scott | 244/35 R |
| 4,186,860 | A * | 2/1980 | Reba | 226/91 |
| 4,321,107 | A | 3/1982 | Page | |
| 5,395,071 | A * | 3/1995 | Felix | 244/35 R |
| 5,759,352 | A * | 6/1998 | Lau et al. | 162/272 |
| 6,558,514 | B2 | 5/2003 | Rouhiainen et al. | |
| 6,928,912 | B2 * | 8/2005 | Drefs et al. | 83/99 |
| RE39,601 | E | 5/2007 | Svanqvist et al. | |
| 2005/0223593 | A1 * | 10/2005 | Rocheleau | 34/638 |

* cited by examiner

*Primary Examiner* — Eric Hug
*Assistant Examiner* — Peter Chin
(74) *Attorney, Agent, or Firm* — Nixon & Vanderhye P.C.

(57) ABSTRACT

A web stabilizer adapted to stabilize a web moving across a span between two components of a web machine or machines, the stabilizer including: a surface facing and adjacent the moving web, and at least one transition in the surface of the stabilizer, wherein the transition is a protrusion or recess in the surface between a leading edge of the stabilizer facing a direction of web travel and a trailing edge of the stabilizer.

19 Claims, 5 Drawing Sheets

APPARATUS AND METHOD FOR STABILIZING A MOVING WEB HAVING TRANSITIONS IN A SURFACE ADJACENT THE WEB

CROSS RELATED APPLICATION

This applications claims priority to U.S. Provisional Patent Application Ser. No. 61/157,446 filed Mar. 4, 2009, the entirety of which application is incorporated by reference.

BACKGROUND OF THE INVENTION

Webs of material (including but not limited to tissue paper, towel paper, other papers, board, plastics, and polymers) are transported through spans that typically have web stabilizers, such as shown in U.S. Pat. No. 4,321,107. The webs move at a relatively high speed through the spans and across the stabilizers.

Stabilizers traditionally have a generally flat or planar surface against which the web moves as the web traverses a span. The stabilizer is positioned adjacent the web such that the web is a short distance from the flat surface of the web. The web moves at a high speed, such as 4,000 to 7,000 feet per minute (1,200 to 2,100 meters per minute). The movement of the web induces air flows on both the top and bottom sides of the web. The air flow tends to move at the same speed as the web.

The web may flutter due to disturbances in the air flows on either or both sides of the web. Disturbances may be caused by the laminar air stream immediately adjacent the web, e.g. the air flow boundary layer, to separate from the web such that a disturbed airflow is adjacent the web.

A web stabilizer having a surface immediately adjacent the web reduces the tendency of the web to flutter. U.S. Pat. Nos. 4,321,107 and 4,906,333 disclose examples of web stabilizers. As the web moves across the surface of the stabilizer, the stabilizer provides a physical barrier to web flutter in the direction the stabilizer and tends to smooth the air flow between the stabilizer and web. By smoothing the air flow, a laminar boundary layer air flow may be maintained adjacent the web, which reduces flutter of the web.

A difficulty with conventional stabilizers is that the web tends to fall away from the surface of the stabilizer, especially if the surface is long in the direction of web travel and the web travels below the stabilizer. Bump bars have been added to the leading edges of stabilizers to reduce flutter. A bump bar is a pipe or bar (circular in cross-section) welded to the leading edge of the stabilizer and extending below (in the direction of the web) the stabilizer such that the web first moves over the bar before moving over the bottom surface of the stabilizer.

Another approach to overcome the difficulty of web flutter below a stabilizer is to inject a high velocity air stream in the gap between the stabilizer surface and web, such as disclosed in U.S. Pat. No. 6,325,896. The high velocity air reduces the air pressure between the web and stabilizer. The reduced air pressure draws the web towards the stabilizer. However, injecting a high velocity air stream requires an air supply, air ducts and air jets or slots, which increase the cost to make and operate a stabilizer. Further, the air injection nozzles and slots are subject to clogging.

Another approach is to shape the stabilizer as an airfoil such that a low pressure is formed between the stabilizer and the web, as disclosed in U.S. Pat. No. 6,325,896. However, an airfoil shaped stabilizer, that is long relative to the direction of web travel, has difficulty in reducing flutter in the downstream region of the stabilizer. There is a need for web stabilizers that suppress web flutter over long stabilizer surfaces, have low manufacturing and operating costs, and are not susceptible to clogging of air injection nozzles and slots.

BRIEF DESCRIPTION OF THE INVENTION

A web stabilizer has been developed having one or more transitions in the surface facing the web. These transitions may be transverse to the direction of web travel, such as a ridge or step extending the width of a stabilizer or an array of recesses and protrusions on the surface of the stabilizer. Because of the transitions and the movement of the web, a low pressure region is formed immediately downstream of each transition in the direction of web travel. These low pressure regions create a pressure differential between opposite sides of the web that draw (bias) the web towards the surface of the stabilizer.

The transitions in the surface of the web stabilizer create low pressure regions between the web and stabilizer, preferably without injection of high velocity air at the transitions. By arranging the transitions at various locations on the surface of the stabilizer, the low pressure regions formed by the transitions draw the web towards the stabilizer along the length of the stabilizer. The transitions on stabilizers with long surfaces above a web assist in reducing flutter in the web along the entire length of the stabilizer.

Various transition shapes and arrangements of transitions on the stabilizer, such as disclosed herein, are in accordance with the invention. The shapes of transitions include: steps, ridges and grooves extending the width of the surface of a stabilizer and transverse to the direction of web travel; air passages extending from the surface of the stabilizer and facing the web to an exhaust port discharging air to atmospheric pressure or to a suction device such as a dust collector, where the passages are preferably tilted away from the direction of web travel; and arrays of protrusions and recesses on the surface of the stabilizer, wherein the protrusions and recesses are preferably widest in a direction transverse to the direction of web travel.

Further, the surface of the stabilizer between the transitions may be linear, curved, undulating or otherwise shaped. The various shapes and arrangements of transitions on the surface of the stabilizer between the transitions promote a low pressure zone between the stabilizer surface and the web and reduce web flutter.

DETAILED DESCRIPTION OF THE INVENTION

Figure 1A:
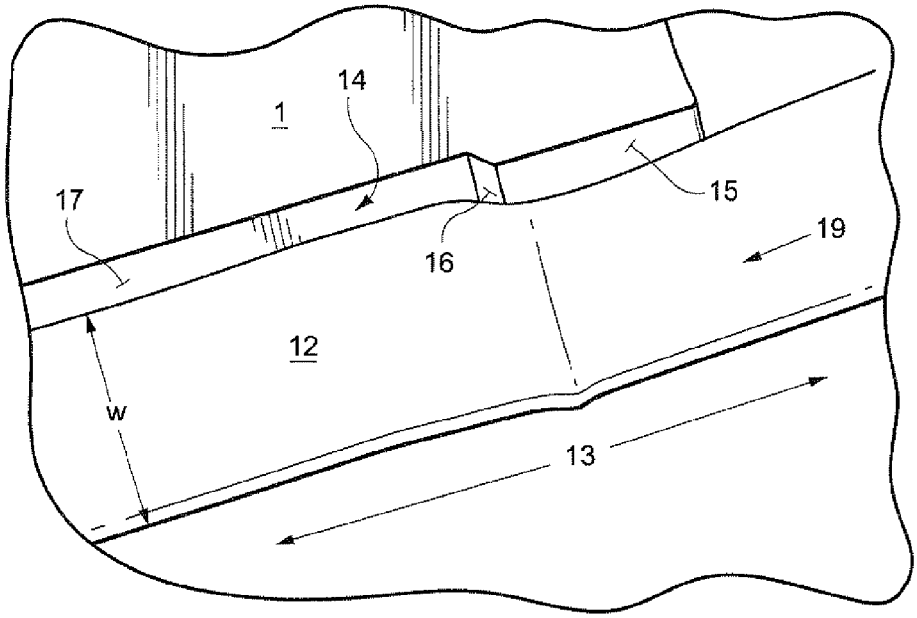
FIG. 1A is a diagram of a web moving across a stabilizer having a step transition.
Figure 1B:
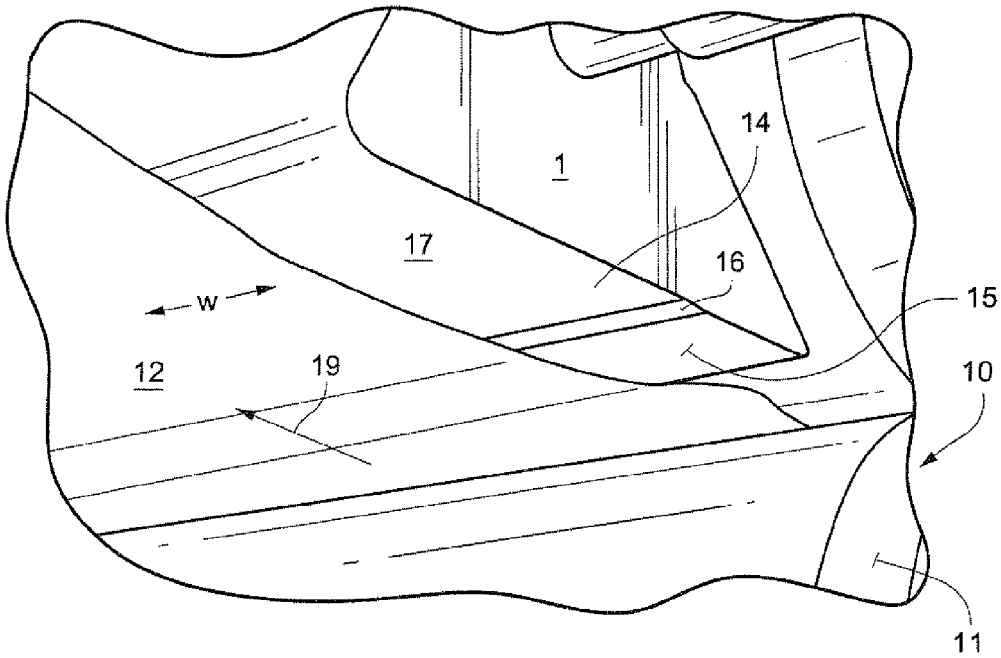
FIG. 1B is a diagram of a web moving across a stabilizer having a surface with a step transition.

FIGS. 1A and 1B show a portion of a tissue machine 10 in which a web 12 moves across a span 13 between components 11, e.g., a calender and a roller, of the machine. A stationary stabilizer 1 is fixed immediately above the web and in the span such that the web moves across a lower surface 14 that is generally parallel to the web.

The lower surface 14 of the stabilizer has a transition 16 extending across the width (W) of the stabilizer. The transition 16 forms a step in the lower surface 14. As the web 12 moves (direction of travel 19) over forward area 15 of the lower surface and the transition 16, the web is drawn up to the rearward area 17 of the lower surface. The web is pulled up because a low pressure region is formed immediately downstream of the transition 16 in the gap between the lower surface and the web. Because the web is pulled up to the lower surface 14, the tendency of the web to flutter is reduced.

The transition 16 may be arranged at various locations along the length of the lower surface of the stabilizer. For example, transitions 16 may be arranged at intervals of one third the length of the lower surface. Preferably, a least one transition 16 is at the upstream half or third of the length of the lower surface 14 of the stabilizer in the direction 19 of web travel and another transition is at the downstream half or third of the length of the lower surface of the stabilizer. Transitions at the downstream half or third of the stabilizer assist in reducing flutter in the web as the web moves past the stabilizer.

Figure 2:
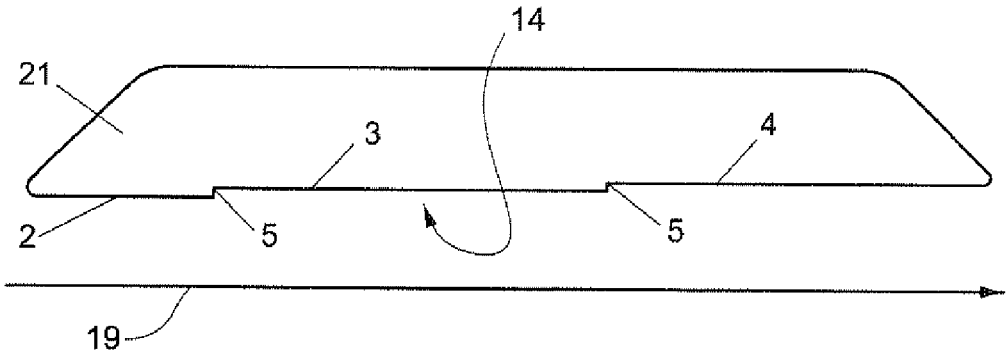
FIG. 2 is a schematic side cross-sectional view of a web stabilizer having a surface with step (square) transitions and planar surface regions between the transitions, where the planar surface regions are substantially parallel to each other and to the direction of web travel.

FIG. 2 shows a stabilizer 21 having a lower surface 14 with substantially parallel surfaces 2, 3 and 4 that are generally planar and arranged sequentially along the direction 19 of web travel. The surfaces 2, 3, and 4 may be substantially parallel with each other and to the direction of web travel. The surfaces 2, 3 and 4 may extend the width of the web and lower surface of the stabilizer.

Separating each of the parallel surfaces 2, 3 and 4, are substantially square step transitions 5 that preferably extend the width of the stabilizer and are transverse to the direction of web travel 19. These square transitions 5 form a step having right angled corners between surfaces 2 and 3 and between surfaces 3 and 4. The step may have a height dimension in a range of, for example, 0.25 inches to 0.75 inches (6.3 to 19 millimeters—mm). The step may also be shorter than this range and have a height, for example, of 0.06 inches (1.5 mm). The step may also be greater than this range and a height, for example, of 1.5 inch (38 mm).

The height of the step transition 5 may be determined to avoid interfering with, e.g., tearing, the web and to form a low pressure region immediately downstream of the step and between the surface of the stabilizer and the web. The transitions 5 may extend substantially the full width of the stabilizer or the width of the web.

The transition 5 may be substantially perpendicular to the direction of web travel. Alternatively, the transitions may be oblique to the direction of web travel, such as at an angle of 75 degrees to 89 degrees to the direction of web travel. Further the transition may not form a straight line and have portions that are perpendicular to the web travel and other portions that are canted with respect to the direction of web travel.

The transition may be formed by making corners or sloped surfaces in the lower surface of the stabilizer, by overlapping plates on the lower surface where the plates are separated by a narrow gap, or by some other irregular shape on the lower surface of the stabilizer.

The square transitions 5 may be formed of one or more bars or other machined pieces that are fixed, e.g., welded or fastened, to the lower surface of the stabilizer. The square transitions 5 may form structural supports for panels forming the surfaces 2, 3 and 4. The joints between the square transitions 5 and panels forming the surfaces 2, 3 and 4 may be sealed to avoid air entering or escaping from or to an interior portion of the stabilizer. Alternatively, the joints may not be sealed such that the air pressure in the region immediately downstream of each transition equalizes with an air pressure, e.g., ambient atmospheric pressure, inside the body of the stabilizer.

Figure 3:
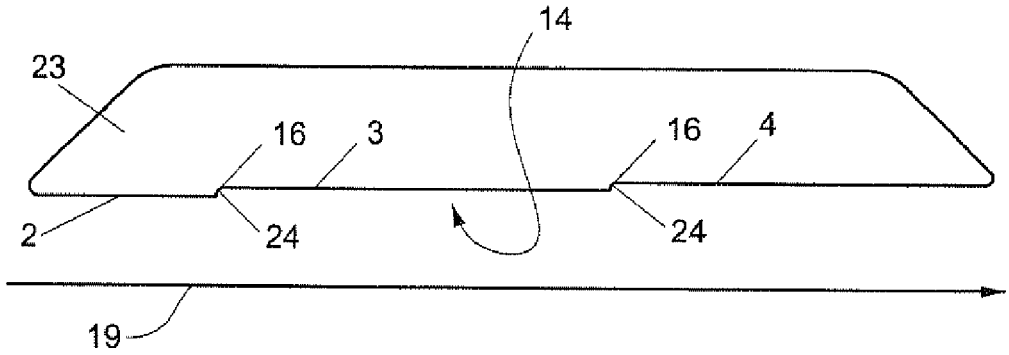
FIG. 3 is a schematic side and cross-sectional view of a web stabilizer having a surface with step (concave or fillet) transitions and planar surface regions between the transitions, where the planar surface regions are substantially parallel to each other and to the direction of web travel.

FIG. 3 shows a stabilizer 23 with substantially parallel planar regions 2, 3 and 4 on a lower surface 14 of the stabilizer. Similar to the stabilizer 21 shown in FIG. 2, the planar regions 2, 3, and 4 are separated by transitions that extend the width of the stabilizer and are generally transverse to the direction 19 of web travel. The transitions 16 form steps between the regions 2 and 3 and between regions 3 and 4.

The transitions 16 are concave steps 24, filleted steps or otherwise curved steps at the joints between the surfaces 2, 3 and 4. The transitions 16 may be formed from one or more pieces, e.g., bars, machined to form a concave, filleted or curved shape 24. The pieces of the transition 16 are manufactured and assembled, e.g., welded or fastened, to the stabilizer and may provide structural support for the panels forming the regions 2, 3, and 4. The concave or filleted shape 24 of the transition 16 reduces the open corner volume at the transition 5 as compared to the square transition shown in FIG. 2 and thereby minimizes dust and contamination build-up in the transition corner volume immediately downstream and adjacent to the curved shape 24 of the transition 16.

Figure 4:
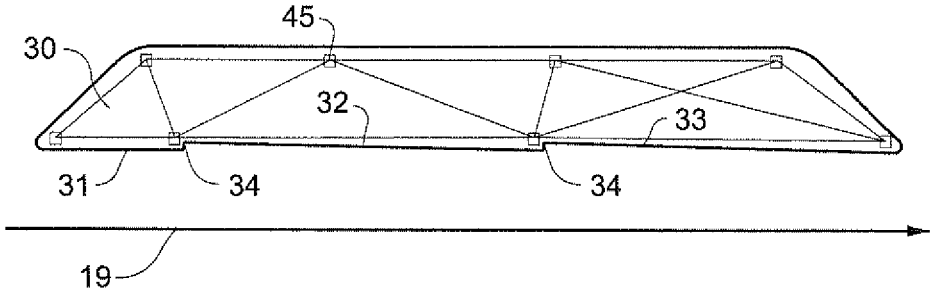
FIG. 4 is a schematic side and cross-sectional view of a web stabilizer having a surface with step (square) transitions and planar surface regions between the transitions, where the planar surface regions are substantially parallel to each other and are inclined with respect to the direction of web travel.

FIG. 4 shows a stabilizer 30 with substantially flat lower surfaces 31, 32 and 33 and a square step transition 34 between these surfaces. The lower surfaces may not be parallel to the web direction and may be parallel to each other. The lower surfaces 31, 32 and 33 may be inclined with respect to the web direction at an angle of 2 to 10 degrees such that the surfaces slope towards the web in the direction 19 of web travel. The transitions 34 may be substantially the full width of the stabilizer 30 and substantially perpendicular to the direction of web travel.

Figure 5:
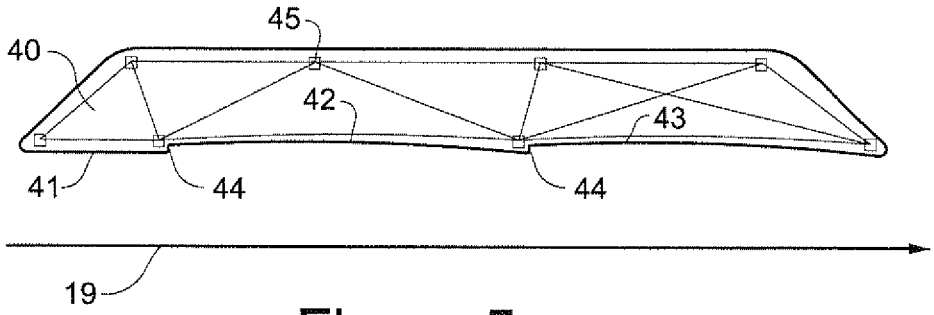
FIG. 5 is a schematic side and cross-sectional view of a web stabilizer having a surface with step (square) transitions extending the width of the stabilizer and the stabilizer has concave surface regions between the transitions.

FIG. 5 shows a stabilizer 40 having a lower surface with concave surface regions 41, 42 and 43, separated by step transitions 44. The concave surface regions may or may not be parallel with the direction of web travel. The transitions 44 may be substantially the full width of the stabilizer 40 or the web, and substantially perpendicular to the direction 19 of web travel. The transitions 44 may be formed in the same manner as the transitions shown in FIGS. 2 to 4. The concave surface regions 41, 42 and 43 may be panels bowed to form a concave shape and supported at the transitions 44 and by the internal supports 45 (shown in FIGS. 4 and 5) in the stabilizer, such as internal ribs and support grids. These internal supports may also be included in the other stabilizers disclosed herein. Further, the surface regions 41, 42 and 43 may have convex surfaces rather than the concave surfaces shown in FIG. 5.

Figure 6:
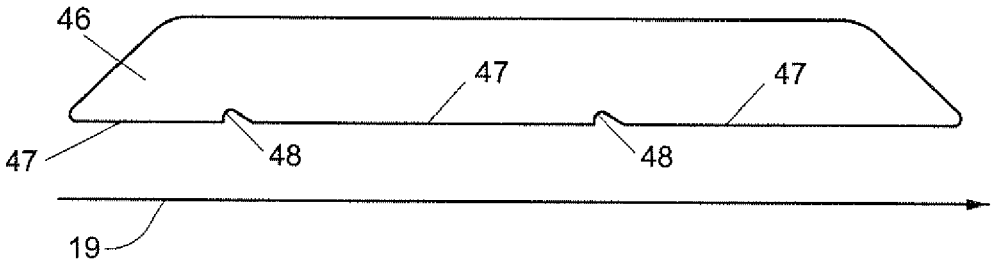
FIG. 6 is a schematic side and cross-sectional view of a web stabilizer having a planar surface which is generally parallel to the direction of web travel, the surface has grooves or concave transitions extending the width of the surface at intervals along the length of the surface.

FIG. 6 a stabilizer 46 with a lower surface formed of parallel surfaces 47 separated by substantially concave transitions 48, e.g., grooves. The surfaces 47 are substantially parallel with the web direction. The transitions 48 may extend substantially the full width of the stabilizer and be substantially perpendicular to the direction of web travel. The surfaces 47 may be substantially planar with each other and interrupted by the recessed transition slots 48. The transition slots 48 may be one or more pieces, e.g., bars, machined to have grooves forming the transition slots. The pieces are mounted in the stabilizer and may provide structural support for the panels forming the surfaces 47.

Figure 7:
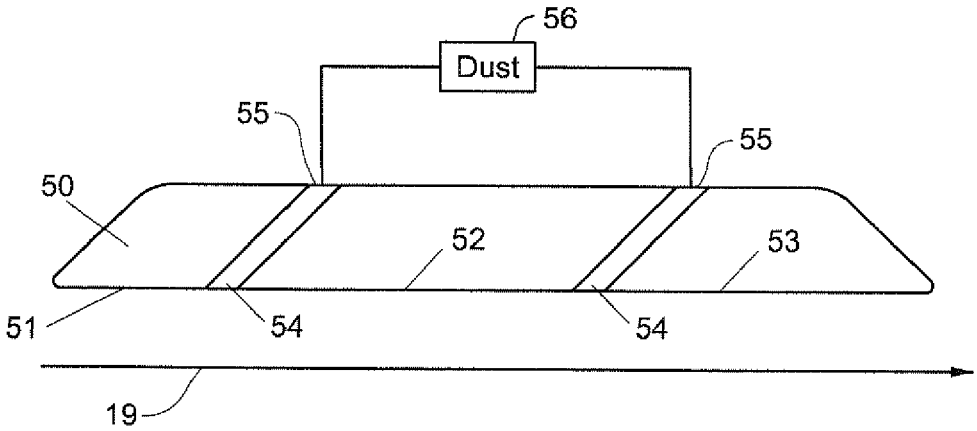
FIG. 7 is a schematic and side cross-sectional view of a web stabilizer having a planar surface which is generally parallel to the direction of web travel, the surface has slots or passages preferably extending traverse to the direction of web travel, where the slots or passages allow air from between the web and stabilizer surface to exhaust and thereby form low pressure regions at the inlet to slots and passages on the surfaces.

FIG. 7 shows a stabilizer 50 having a lower surface that may be formed of substantially parallel lower surface sections 51, 52 and 53 separated by slots, other air passages or open areas 54. The surface(s) 51, 52 and 53 may be in a plane substantially parallel with the web direction and may be parallel to each other.

The slots, air passage or open areas (collectively transitions) 54 may extend the width of the stabilizer (or the width of the web) and be generally perpendicular (or oblique) to the direction of web travel. The transitions 54 may be formed by one or more pieces, e.g., bars, machined to an appropriate shape and assembled, e.g., welded or fastened, in the stabilizer to form the slots, passage or open areas.

The transitions 54 have air inlets adjacent the lower surface sections 51, 52 and 53. The transitions 54 have outlets 55 that exhaust air from a surface of the stabilizer distant from the lower surfaces 51, 52 and 53 or to an internal air duct in the stabilizer. The outlets 55 may exhaust to the atmosphere at an ambient air pressure or to another device, such as a dust collection system 56, e.g., a vacuum, that applies suction to the outlets 55 and transitions 54 to draw air from the inlets to the transitions. The ducts of the transitions 54 may be inclined, e.g., at an angle of 30 to 55 degrees with respect to the lower surfaces 51, 52 and 53 and sloped such that the inlet is upstream of the outlet 36 in the direction of web travel. The transitions 54 allow a portion of the air moving with the web and between the web and the lower surfaces 51, 52 and 53 to flow into the transitions and thereby create a low pressure region between the web and the lower surfaces.

Figure 8:
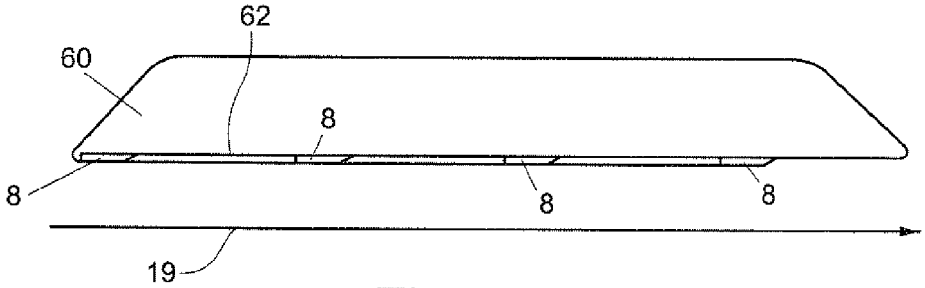
FIG. 8 is a schematic and side cross-sectional view of a web stabilizer having a surface with an array of recesses and protrusions.
Figure 9:
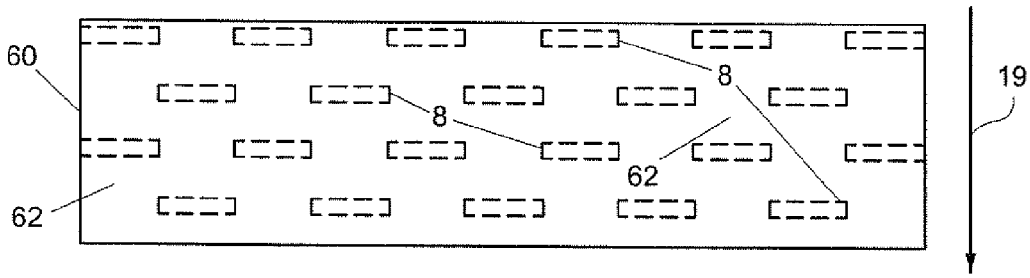
FIG. 9 is a schematic plan view of the surface of the stabilizer shown in FIG. 8.

FIGS. 8 and 9 show a stabilizer 60 with a lower surface 62 that may be in a plane substantially parallel to the web. The lower surface may have convex or concave regions, and step transitions as shown in FIGS. 2 to 7.

The lower surface 62 includes an array of transitions 8 which may be undulating regions in which the surface gradually rises and falls from the web. For example, the transitions may include recesses or protrusions 8 that have a width dimension perpendicular to the direction of web travel that is substantially greater than a length dimension. For example, a transition 8 may be a generally rectangular bump on the lower surface 62 having a width of between 50 mm to 500 mm, a length (parallel to web travel) of 20 mm to 200 mm and a height of 5 to 20 mm. These transitions 8 may have a sloped leading edge facing the direction 19 of web travel and a sharp cornered, e.g., 90 degree corners, trailing edge to form air disturbances and low pressures immediately downstream of the transitions.

The transitions 8 may be arranged in an array such that the transitions are arranged in rows parallel to the direction of web travel and the transitions are staggered from row to row as shown in FIG. 9.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A web stabilizer adapted to stabilize a web moving across a span between two components of a web machine or machines, the stabilizer comprising a surface facing and adjacent the moving web, and at least one transition in the surface of the stabilizer, wherein the transition is a protrusion or recess in the surface between a leading edge of the stabilizer facing a direction of web travel and a trailing edge of the stabilizer and further wherein the transition and the surface in a region adjacent the transition are devoid of air nozzles injecting fluid between the moving web and the surface.

2. The web stabilizer in claim 1 wherein the transition is a plurality of transitions arranged between the leading edge and the trailing edge.

3. The web stabilizer in claim 1 wherein the transition is short in a direction parallel to the direction of the movement of the web and long in a direction perpendicular to the movement of the web.

4. The web stabilizer in claim 1 wherein the transition extends across the lower surface at least a width of the web.

5. The web stabilizer in claim 1 wherein the transition is a step between a first region of the surface of the stabilizer and a second region, wherein the first region is upstream of the second region along a direction of movement of the web.

6. The web stabilizer in claim 5 wherein the first and second regions are planar and parallel to each other.

7. The web stabilizer in claim 5 wherein the first and second regions are convex or concave.

8. The web stabilizer in claim 1 in which the transition is a step having perpendicular corners.

9. The web stabilizer in claim 1 wherein the transition is a step having a curved or filleted internal corner.

10. The web stabilizer in claim 1 wherein the transition is a groove or recess in the surface of the stabilizer, and the groove or recess spans a width of the web.

11. The web stabilizer in claim 1 wherein the transition is arranged in a downstream half of third of the surface, wherein downstream is with respect to the direction of web travel.

12. The web stabilizer in claim 1 wherein the transition is an array of protrusions on or recesses in the surface.

13. A web stabilizer adapted to stabilize a web moving across a span between two components of a web machine or machines, the stabilizer comprising:

a stabilizer body having a surface facing, parallel to and adjacent the moving web, wherein the stabilizer body is mounted in the span between the two components of the web machine or machines, and at least one transition in the surface of the stabilizer, wherein the transition is a protrusion or recess in the surface between a leading edge of the surface of the stabilizer facing a direction of web travel and a trailing edge of the surface of the stabilizer and further wherein the transition and the surface in a region adjacent the transition are devoid of air nozzles injecting fluid between the moving web and the surface.

14. The web stabilizer of claim 13 wherein the transition protrudes or is recessed in the surface of the stabilizer in a range of 5 to 20 millimeters (mm).

15. The web stabilizer of claim 13 wherein the transition includes a bump on the surface, and the bump has a width of between 50 mm to 500 mm in a direction parallel to the web, a length extending parallel to a direction of web travel of 20 mm to 200 mm, and a height of 5 to 20 mm in a direction perpendicular to the web.

16. The web stabilizer in claim 13 wherein the transition is a plurality of transitions arranged between the leading edge and the trailing edge.

17. The web stabilizer in claim 13 wherein the transition is short in a direction parallel to a direction of the movement of the web and long in a direction perpendicular to the movement of the web.

18. The web stabilizer in claim 13 wherein the transition is a step between a first region of the surface of the stabilizer and a second region, wherein the first region is upstream of the second region along a direction of movement of the web.

19. The web stabilizer in claim 13 wherein the first and second regions are convex or concave.

* * * * *